US010976123B1

(12) United States Patent
Rich

(10) Patent No.: US 10,976,123 B1
(45) Date of Patent: Apr. 13, 2021

(54) ADJUSTABLE MAGAZINE LOCKUP NOTCH

(71) Applicant: Black Dog Machine LLC, Nampa, ID (US)

(72) Inventor: Kevin Wayne Rich, Middleton, ID (US)

(73) Assignee: BLACK DOG MACHINE LLC, Nampa, ID (US)

( * ) Notice: Subject to any disclaimer, the term of this patent is extended or adjusted under 35 U.S.C. 154(b) by 0 days.

(21) Appl. No.: 16/863,322

(22) Filed: Apr. 30, 2020

(51) Int. Cl.
*F41A 9/65* (2006.01)
*F41A 17/38* (2006.01)

(52) U.S. Cl.
CPC ..... *F41A 17/38* (2013.01); *F41A 9/65* (2013.01)

(58) Field of Classification Search
CPC ..... F41A 9/61; F41A 9/63; F41A 9/64; F41A 9/65; F41A 17/38
USPC ..... 42/49.01, 49.02, 50; 89/33.01, 33.02, 89/33.1, 33.14, 33.16, 33.17
See application file for complete search history.

*Primary Examiner* — Jonathan C Weber
(74) *Attorney, Agent, or Firm* — Parsons Behle & Latimer

(57) ABSTRACT

Apparatus, systems, and methods for an adjustable magazine lockup. A magazine body includes a slot in a first side with feed lips connected to the top side. The feed lips have a top edge positioned away from the top side of the magazine body. A first insert with a first lockup notch may be positioned within the slot so that there is a first distance from the top edge of the feed lips to a centerline of the first lockup notch. The insert may be replaced to change to the top edge of the feed lips. A second insert having a second lockup notch may be inserted into the slot in the first side of the magazine body to increase the distance and a third insert having a third lockup notch may be inserted into the slot in the first side of the magazine body to decrease the distance.

20 Claims, 6 Drawing Sheets

ADJUSTABLE MAGAZINE LOCKUP NOTCH

FIELD OF THE DISCLOSURE

The examples described herein relate to apparatus, systems, and methods for an adjustable magazine lockup notch.

BACKGROUND

Description of the Related Art

Firearm magazines are designed to selectively retain a plurality of rounds and to selectively be inserted into a receiver of a firearm. Various mechanisms may be used to selectively retain the magazine within the receiver of a firearm so that rounds from the magazine may be delivered to the firing mechanism. For example, magazines designed to be used with an AR-15 include a lockup notch on the exterior of the magazine with the magazine catch of the receiver engaging the lockup notch to selectively secure the magazine within the receiver. When positioned a loaded magazine is positioned within an AR-15 receiver, the forward motion of the bolt strips a round from the feed lips of the magazine moving the round into the firing chamber. The distance between the top edge of the feed lips and a centerline of the lockup notch may not be configured for optimal performance of the firearm due to variances in the configurations of the receivers and/or magazines. For example, a firearm may periodically jam while cycling due to the distance not be optimized. This may be more prevalent when rimfire ammunition is used in a magazine but is also applicable to centerfire ammunition. Other disadvantages may exist.

SUMMARY

The present disclosure is directed to apparatus, systems, and methods for an adjustable magazine lockup notch.

One example of the present disclosure is an apparatus comprising a magazine body having a first side, a second side opposite the first side, a front side, a back side opposite the front side, a top side, and a bottom opposite the top side; the magazine body being configured to receive and selectively retain firearm cartridges, the magazine body having a slot in the first side. The apparatus includes feed lips connected to the top side of the magazine body, the feed lips having a top edge positioned away from the top side of the magazine body. The apparatus includes an insert positioned within the slot, the insert including a lockup notch and wherein the insert is selectively removable from the magazine body.

The lockup notch of the insert has a longitudinal centerline, the longitudinal centerline being a first distance from the top edge of the feed lips. The insert may be replaced to change the first distance between the top edge of the feed lips and the longitudinal centerline of the lockup notch. The apparatus may include finger grips on the front side of the magazine body. The apparatus may include a ridge along the back side, wherein the ridge extends away from the back side. The insert may include an aperture to receive a fastener. The apparatus may include a fastener positioned within the aperture of the insert that selectively secures the insert to the magazine body.

One example of the present disclosure is a system comprising a magazine body having a first side, a second side opposite the first side, a front side, a back side opposite the front side, a top side, and a bottom opposite the top side; the magazine body being configured to receive and selectively retain firearm cartridges, the magazine body having a slot in the first side The system includes feed lips connected to the top side of the magazine body, the feed lips having a top edge positioned away from the top side of the magazine body. The system includes a first insert having a first lockup notch with a first longitudinal centerline, wherein when the first insert is positioned within the slot in the first side of the magazine body the first longitudinal centerline is a first distance from the top edge of the feed lips. The system includes a second insert having a second lockup notch having a second longitudinal centerline, wherein when the second insert is positioned within the slot in the first side of the magazine body the second longitudinal centerline is a second distance from the top edge of the feed lips, the second distance being different from the first distance.

The system may include a third insert having a third lockup notch having a third longitudinal centerline, wherein when the third insert is positioned within the slot in the first side of the magazine body the third longitudinal centerline is a third distance from the top edge of the feed lips, the third distance being different from the first distance and the second distance. The system may include a fourth insert having a fourth lockup notch having a fourth longitudinal centerline, wherein when the fourth insert is positioned within the slot in the first side of the magazine body the fourth longitudinal centerline is a fourth distance from the top edge of the feed lips, the fourth distance being different from the first distance, the second distance, and the third distance. The system may include a fifth insert having a fifth lockup notch having a fifth longitudinal centerline, wherein when the fifth insert is positioned within the slot in the first side of the magazine body the fifth longitudinal centerline is a fifth distance from the top edge of the feed lips, the fifth distance being different from the first distance, the second distance, the third distance, and the fourth distance.

The system may include a sixth insert having a sixth lockup notch having a sixth longitudinal centerline, wherein when the sixth insert is positioned within the slot in the first side of the magazine body the sixth longitudinal centerline is a sixth distance from the top edge of the feed lips, the sixth distance being different from the first distance, the second distance, the third distance, the fourth distance, and the fifth distance. The system may include a seventh insert having a seventh lockup notch having a seventh longitudinal centerline, wherein when the seventh insert is positioned within the slot in the first side of the magazine body the seventh longitudinal centerline is a seventh distance from the top edge of the feed lips, the seventh distance being different from the first distance, the second distance, the third distance, the fourth distance, the fifth distance, and the sixth distance. The system may include an eighth insert having an eighth lockup notch having an eighth longitudinal centerline, wherein when the eighth insert is positioned within the slot in the first side of the magazine body the eighth longitudinal centerline is an eighth distance from the top edge of the feed lips, the eighth distance being different from the first distance, the second distance, the third distance, the fourth distance, the fifth distance, the sixth distance, and the seventh distance.

The system may include a ninth insert having a ninth lockup notch having a ninth longitudinal centerline, wherein when the ninth insert is positioned within the slot in the first side of the magazine body the ninth longitudinal centerline is a ninth distance from the top edge of the feed lips, the ninth distance being different from the first distance, the second distance, the third distance, the fourth distance, the fifth distance, the sixth distance, the seventh distance, and the eighth distance. The second distance may be 0.005 inches longer than the first distance. The third distance may be 0.005 inches shorter than the first distance. The fourth distance may be 0.005 inches longer than the second distance. The fifth distance may 0.005 inches shorter than the third distance. The sixth distance may be 0.005 inches longer than the fourth distance. The seventh distance may be 0.005 inches shorter than the fifth distance. The eighth distance may be 0.005 inches longer than the sixth distance. The ninth distance may be 0.005 inches shorter than the seventh distance.

One example of the present disclosure is a method comprising removing a first insert from a slot in a first side of a magazine body, the first insert having a first lockup notch with a first longitudinal centerline, the first longitudinal centerline being a first distance from a top edge of feed lips connected to a top side of the magazine body. The method includes positioning a second insert into the slot in the first side of the magazine body, the second insert having a second lockup notch with a second longitudinal centerline, the second longitudinal centerline being a second distance from the top edge of feed lips connected to the top side of the magazine body, the second distance being larger than the first distance.

The method may include removing the second insert from the slot in the first side of the magazine body. The method may include positioning a third insert into the slot in the first side of the magazine body, the third insert having a third lockup notch with a third longitudinal centerline, the third longitudinal centerline being a third distance from the top edge of feed lips connected to the top side of the magazine body, the third distance being smaller than the first distance.

The method may include removing the third insert from the slot in the first side of the magazine body. The method may include positioning a fourth insert into the slot in the first side of the magazine body, the fourth insert having a fourth lockup notch with a fourth longitudinal centerline, the fourth longitudinal centerline being a fourth distance from the top edge of feed lips connected to the top side of the magazine body, the fourth distance being larger than the second distance.

The method may include removing the fourth insert from the slot in the first side of the magazine body. The method may include positioning a fifth insert into the slot in the first side of the magazine body, the fifth insert having a fifth lockup notch with a fifth longitudinal centerline, the fifth longitudinal centerline being a fifth distance from the top edge of feed lips connected to the top side of the magazine body, the fifth distance being smaller than the third distance. Other embodiments also exist.

Figure 1:
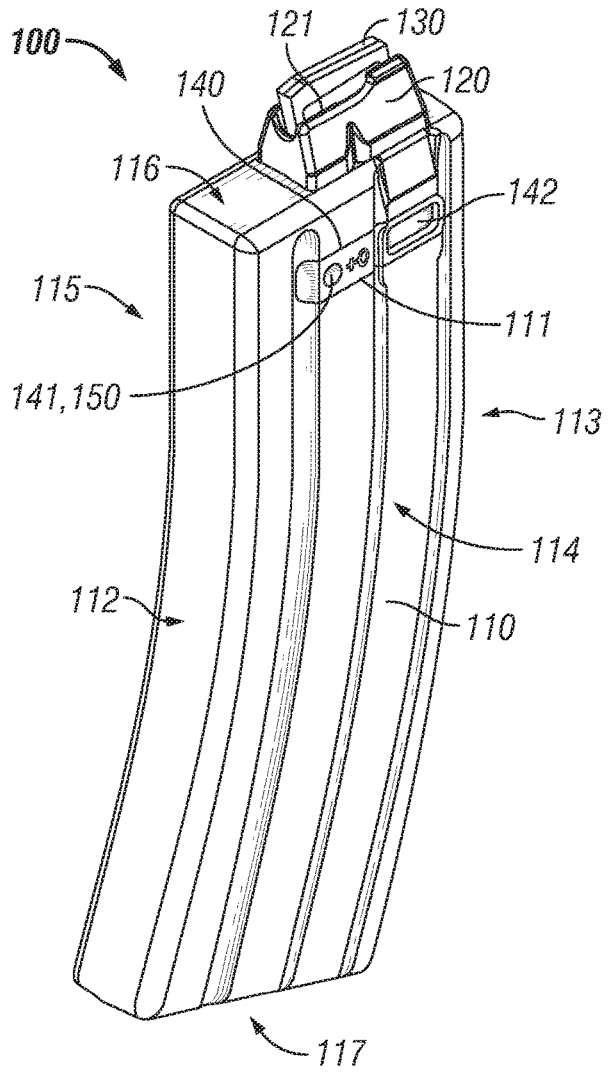
FIG. 1 is a perspective view of an embodiment of a magazine having an adjustable lockup notch.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 is a perspective view of an embodiment of an apparatus 100 having an adjustable lockup notch 142. The apparatus 10 includes a magazine body 110. The magazine body 110 has a first side 114, a second side 115 opposite the first side 114, a top side 116, a bottom side 117 opposite the top side, a front side 112, and a rear side 113 opposite the front side 112. The magazine body 110 may be comprised of a first half connected to a second half. In another embodiment, the magazine body 110 may be comprised of a single magazine body. The apparatus 100 include feed lips 120 having a top edge 121 connected to the top side 116 of the magazine body 110. The apparatus 100 includes a follower 130 connected to a spring (not shown) that is used to move rounds from inside of the magazine body 110 to the feed lips 120 as would be appreciated by one of ordinary skill in the art.

The front side 114 of the magazine body 110 includes a slot 111 in the front side 114. An insert 140 is positioned within the slot 111. The insert 140 includes a lockup notch 142 and an aperture 141. A fastener 150 is positioned within the aperture 141 to selectively secure the insert 140 to the magazine body 110. The lockup notch 142 is configured to be engaged by a magazine catch of a receiver to selectively retain the apparatus 100 within the receiver as would be appreciated by one of ordinary skill in the art having the benefit of this disclosure.

The lockup notch 142 includes a longitudinal centerline 143. The longitudinal line 143 is a distance 160 from the top edge 121 of the feed lips 120. As the insert 140 is removable from the magazine body 110, a different insert 140 may be positioned within the slot 111 in the first side 114 of the magazine body 110 to modify the distance 160 between the centerline 143 of the lock notch 142 and the top edge 121 of the feed lips 120 as discussed herein. The apparatus 100 may be configured to be used with an AR-15 rifle, an AR-10 rifle, or other firearms that utilize a lock notch 142 in the magazine body 110. The apparatus 100 may be used with various centerfire or rimfire ammunition. For example, the apparatus 100 may be used with, but is not limited to, .17 caliber rounds, .22 caliber rounds, .223 caliber rounds, .243 caliber rounds, .300 caliber rounds, .308 caliber rounds, 40 caliber rounds .45 caliber rounds, .50 caliber rounds, 5.45×39 mm rounds, 5.56×45 mm rounds, FN 5.7×26 mm rounds, 9 mm rounds, 10 mm rounds, and .336 Lapua rounds.

Figure 2:
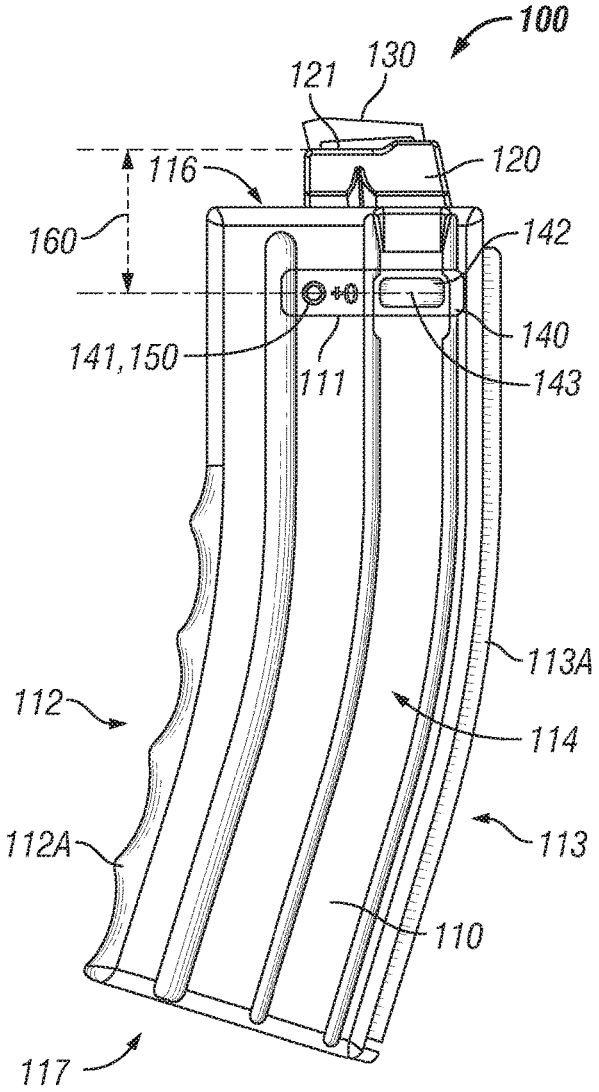
FIG. 2 is a side view of an embodiment of a magazine having an adjustable lockup notch.

FIG. 2 is a side view of an embodiment of an apparatus 100 having an adjustable lockup notch 142. The apparatus 100 includes a magazine body 110. The magazine body 110 has a first side 114, a second side 115 opposite the first side 114, a top side 116, a bottom side 117 opposite the top side, a front side 112, and a rear side 113 opposite the front side 112. The front side 112 includes finger grips 112A and the back side 113 includes ridge 113A. Ridge 113A is a raised ridge that extends away from the surface of the back side 113. The apparatus 100 include feed lips 120 having a top edge 121 connected to the top side 116 of the magazine body 110. The apparatus 100 includes a follower 130 connected to a spring (not shown) that is used to move rounds from inside of the magazine body 110 to the feed lips 120 as would be appreciated by one of ordinary skill in the art.

The front side 114 of the magazine body 110 includes a slot 111 in the front side 114. An insert 140 having an aperture 141 and a lockup notch 142 is positioned within the slot 111. The lockup notch 142 is configured to be engaged by a magazine catch of a receiver to selectively retain the apparatus 100 within the receiver as would be appreciated by one of ordinary skill in the art having the benefit of this disclosure. Different inserts 140 having lockup notches 142 with different longitudinal centerlines 143 may be inserted to modify or adjust the distance 160 between the centerline 143 of the lock notch 142 and the top edge 121 of the feed lips 120.

Figure 3:
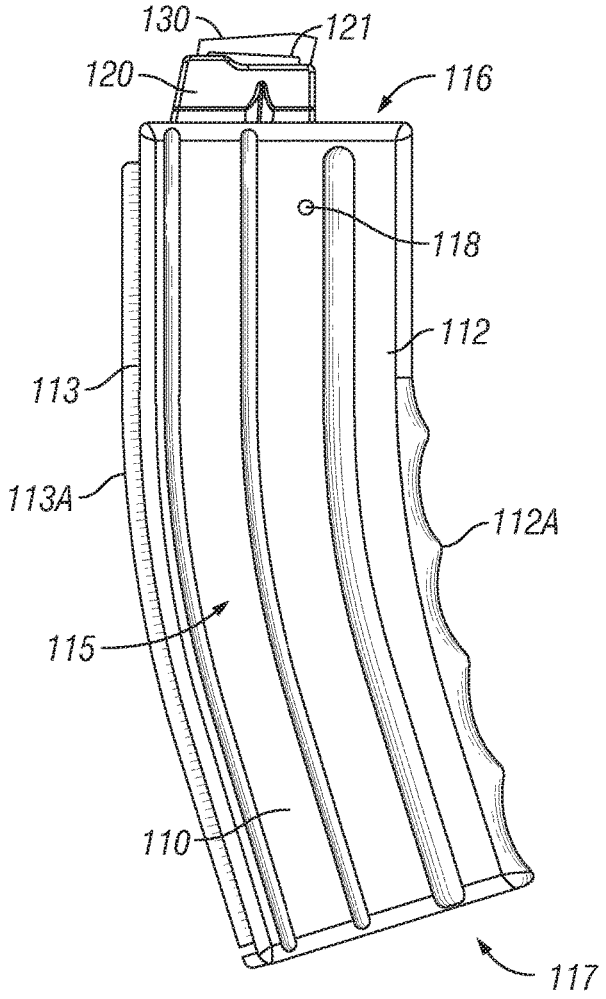
FIG. 3 is a side view of an embodiment of a magazine having an adjustable lockup notch.

FIG. 3 is a side view of an embodiment of an apparatus 100 having an adjustable lockup notch 142. The apparatus 100 includes a magazine body 110. The magazine body 110 has a first side 114, a second side 115 opposite the first side 114, a top side 116, a bottom side 117 opposite the top side, a front side 112, and a rear side 113 opposite the front side 112. The second side 115 of the magazine body 110 includes a threaded insert 118 into which the fastener 150 may be threaded into to secure the insert 140 into the slot 111 on the first side of the magazine body 110.

Figure 4:
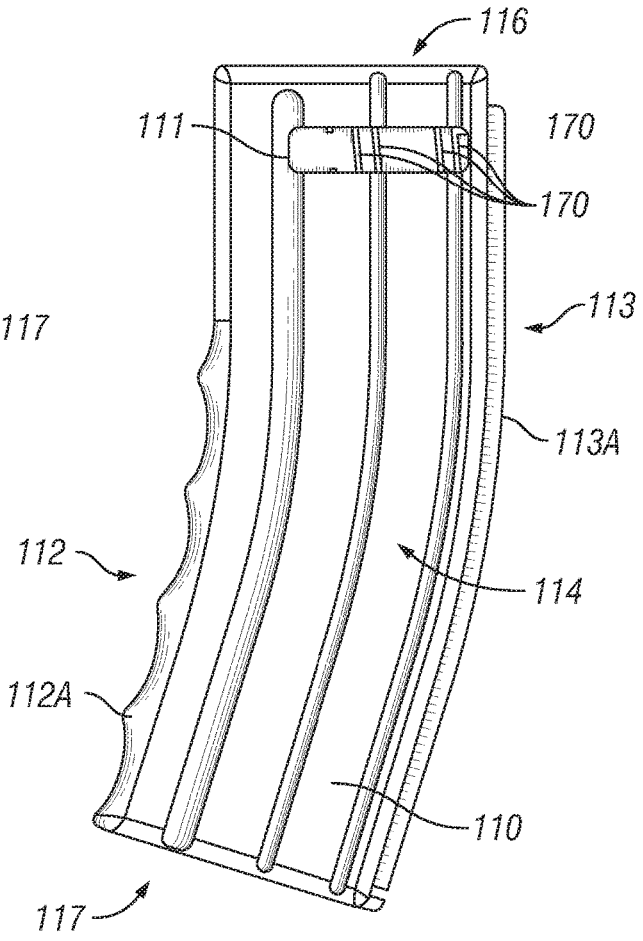
FIG. 4 is a side view of an embodiment of a magazine body.

FIG. 4 is a side view of an embodiment of a magazine body 110. The insert 140 has been removed from slot 111 in the first side 114 of the magazine body 110. The magazine body 110 includes a plurality of internal guides 170 that are configured to guide rounds to the feed lips (not shown in FIG. 4) connected to the top side 116 of the magazine body 110. The guides 170, follower 130, and spring (not shown) are configured to deliver rounds from within the magazine body 110 to the feed lips 120 as would be appreciated by one of ordinary skill in the art having the benefit of this disclosure.

Figure 5:
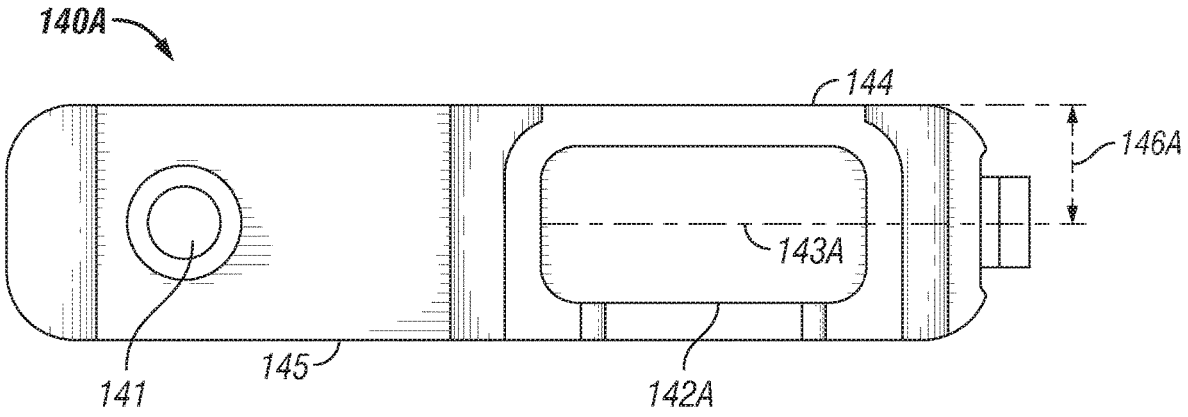
FIG. 5 is a front view schematic of an embodiment of an insert having a lockup notch.
Figure 6:
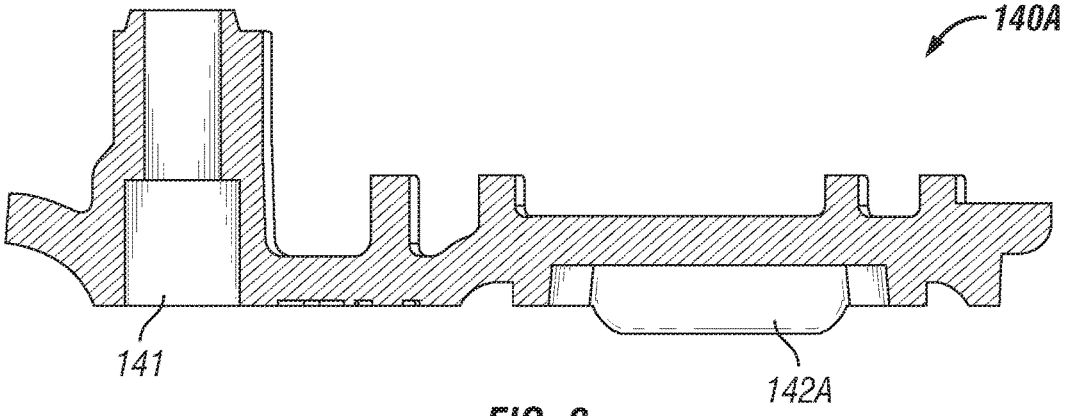
FIG. 6 is cross-sectional view schematic of an embodiment of an insert having a lockup notch.

FIG. 5, is a front view schematic of an embodiment of a first insert 140A having a first lockup notch 142A that has a first longitudinal centerline 143A. FIG. 6 is a cross-sectional view of the first insert 140A of FIG. 5. The first insert 140A includes an aperture 141 configured to receive a fastener to secure the first insert 140A to a magazine body 110. The first insert 140A includes a top edge 144 and a bottom edge 145. The first insert 140A has a first distance 146A between the top edge 144 and the first longitudinal centerline 143A of the first lock notch 142A. Changing the distance between the top edge 144 of an insert 140 to the longitudinal centerline 143 of the lock notch 142 will change the distance 160 between the longitudinal centerline 143 and the top edge 121 of the feed lips 120, which may alter the cycling operation of the firearm as would be appreciated by one of ordinary skill in the art having the benefit of this disclosure.

Figure 7:
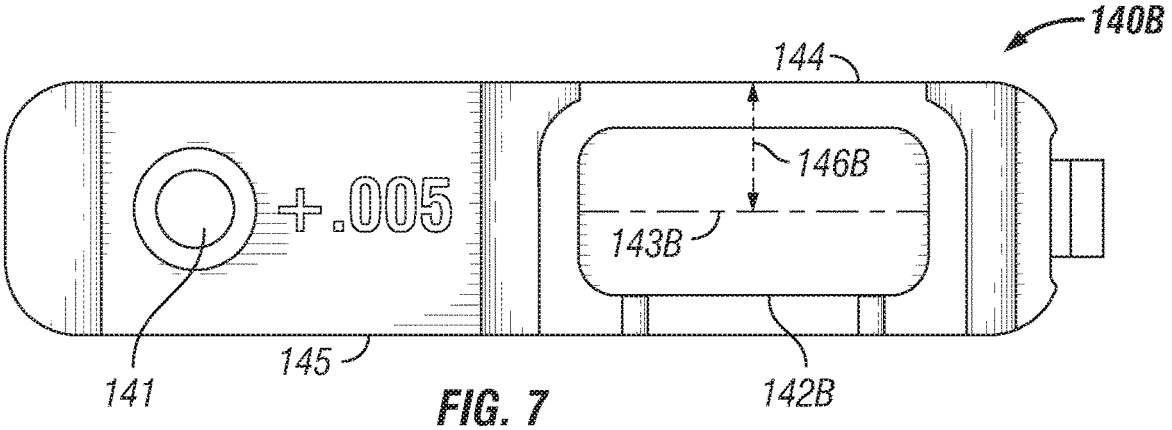
FIG. 7 is a front view schematic of an embodiment of an insert having a lockup notch.

FIG. 7, is a front view schematic of an embodiment of a second insert 140B having a second lockup notch 142B that has a second longitudinal centerline 143B. The second insert 140B includes an aperture 141 configured to receive a fastener to secure the second insert 140B to a magazine body 110. The second insert 140B includes a top edge 144 and a bottom edge 145. The second insert 140B has a second distance 146B between the top edge 144 and the second longitudinal centerline 143B of the second lock notch 142B. The second distance 146B is larger than the first distance 146A. Thus, the distance 160 from the top edge 121 of the feed lips 120 is larger when the first insert 140A is replaced by the second insert 140B. The second distance 146B may be 0.005 inches larger that the first distance 146A which increase the distance 160 by the same amount.

Figure 8:
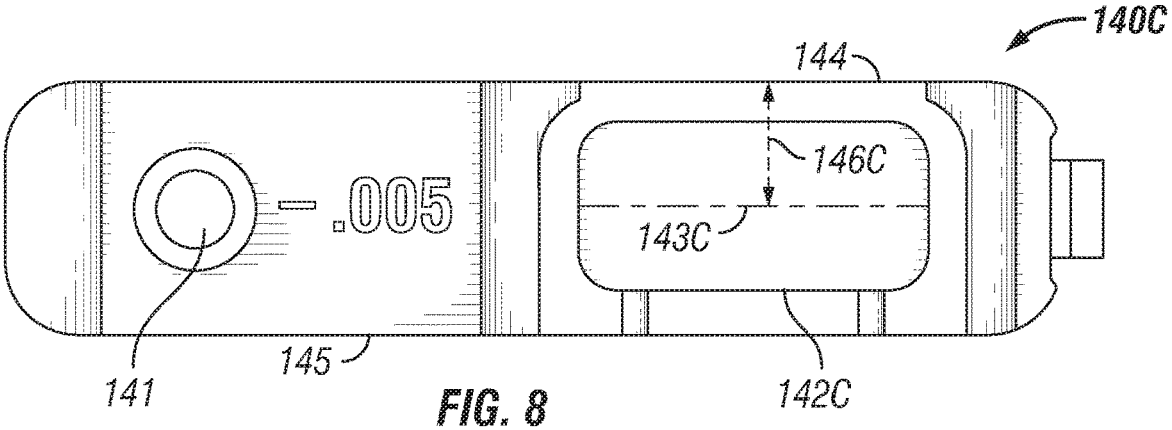
FIG. 8 is a front view schematic of an embodiment of an insert having a lockup notch.

FIG. 8, is a front view schematic of an embodiment of a third insert 140C having a third lockup notch 142C that has a third longitudinal centerline 143C. The third insert 140C includes an aperture 141 configured to receive a fastener to secure the third insert 140C to a magazine body 110. The third insert 140C includes a top edge 144 and a bottom edge 145. The third insert 140C has a third distance 146C between the top edge 144 and the third longitudinal centerline 143C of the third lock notch 142C. The third distance 146C is shorter than the first distance 146A. Thus, the distance 160 from the top edge 121 of the feed lips 120 is shorter when the first insert 140A is replaced by the third insert 140C. The third distance 146C may be 0.005 inches shorter that the first distance 146A which decrease the distance 160 by the same amount.

Figure 9:
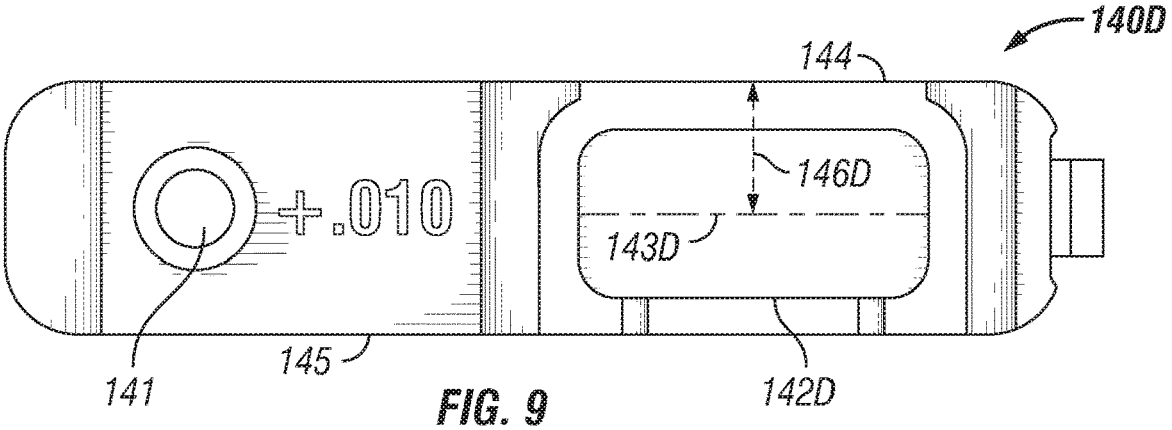
FIG. 9 is a front view schematic of an embodiment of an insert having a lockup notch.

FIG. 9, is a front view schematic of an embodiment of a fourth insert 140D having a fourth lockup notch 142D that has a fourth longitudinal centerline 143D. The fourth insert 140D includes an aperture 141 configured to receive a fastener to secure the fourth insert 140D to a magazine body 110. The fourth insert 140D includes a top edge 144 and a bottom edge 145. The fourth insert 140D has a fourth distance 146D between the top edge 144 and the fourth longitudinal centerline 143D of the fourth lock notch 142D. The fourth distance 146D is larger than the first distance 146A and is larger than the second distance 146B. Thus, the distance 160 from the top edge 121 of the feed lips 120 is larger when the first insert 140A or the second insert 140B is replaced by the fourth insert 140D. The fourth distance 146D may be 0.010 inches larger that the first distance 146A which increase the distance 160 by the same amount.

Figure 10:
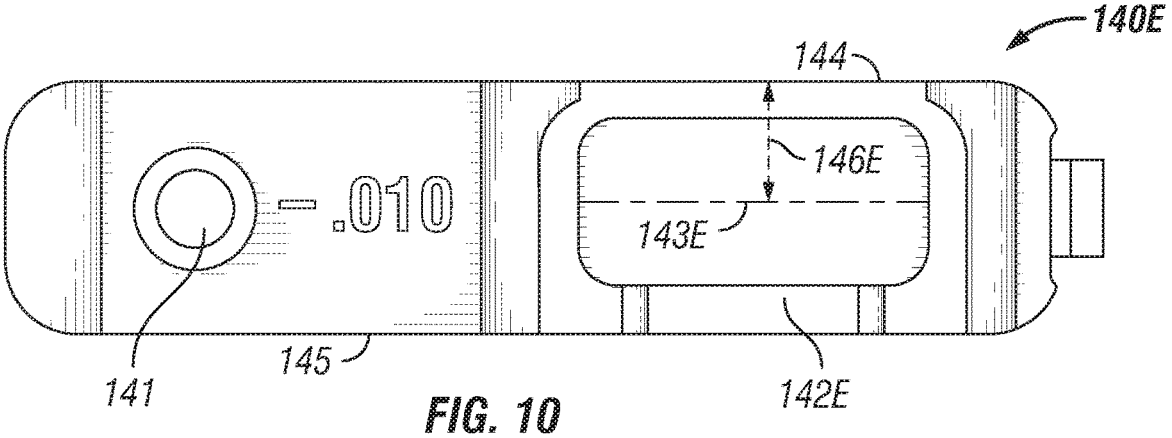
FIG. 10 is a front view schematic of an embodiment of an insert having a lockup notch.

FIG. 10, is a front view schematic of an embodiment of a fifth insert 140E having a fifth lockup notch 142E that has a fifth longitudinal centerline 143E. The fifth insert 140E includes an aperture 141 configured to receive a fastener to secure the fifth insert 140E to a magazine body 110. The fifth insert 140E includes a top edge 144 and a bottom edge 145. The fifth insert 140E has a fifth distance 146E between the top edge 144 and the fifth longitudinal centerline 143E of the fifth lock notch 142E. The fifth distance 146E is smaller than the first distance 146A and is smaller than the third distance 146C. Thus, the distance 160 from the top edge 121 of the feed lips 120 is smaller when the first insert 140A or the third insert 140C is replaced by the fifth insert 140E. The fifth distance 146E may be 0.010 inches smaller that the first distance 146A which decreases the distance 160 by the same amount.

Figure 11:
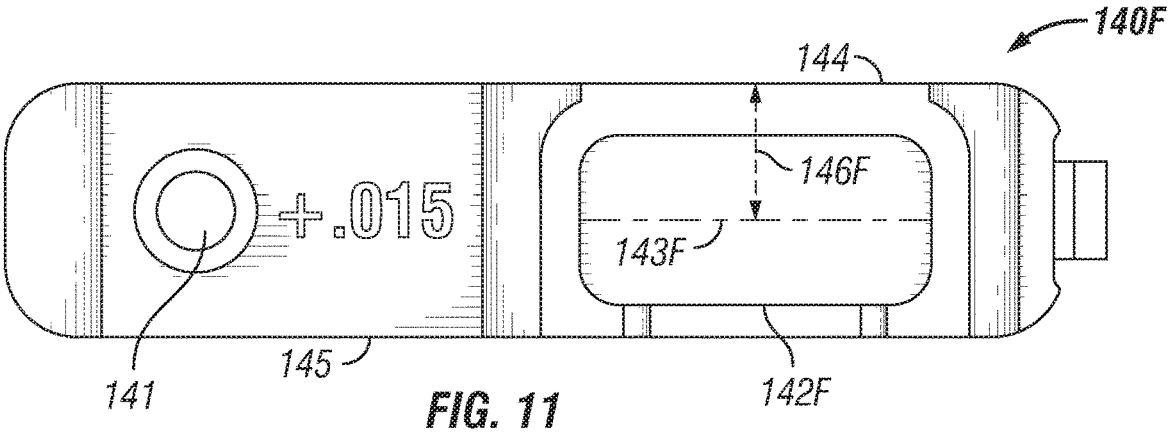
FIG. 11 is a front view schematic of an embodiment of an insert having a lockup notch.

FIG. 11, is a front view schematic of an embodiment of a sixth insert 140F having a sixth lockup notch 142F that has a sixth longitudinal centerline 143F. The sixth insert 140F includes an aperture 141 configured to receive a fastener to secure the sixth insert 140F to a magazine body 110. The sixth insert 140F includes a top edge 144 and a bottom edge 145. The sixth insert 140F has a sixth distance 146F between the top edge 144 and the sixth longitudinal centerline 143F of the sixth lock notch 142F. The sixth distance 146F is larger than the first distance 146A, is larger than the second distance 146B, and is larger than the fourth distance 146D. Thus, the distance 160 from the top edge 121 of the feed lips 120 is larger when the first insert 140A, the second insert 140B, or the fourth insert 140D are replaced by the sixth insert 140F. The sixth distance 146F may be 0.015 inches larger that the first distance 146A which increase the distance 160 by the same amount.

Figure 12:
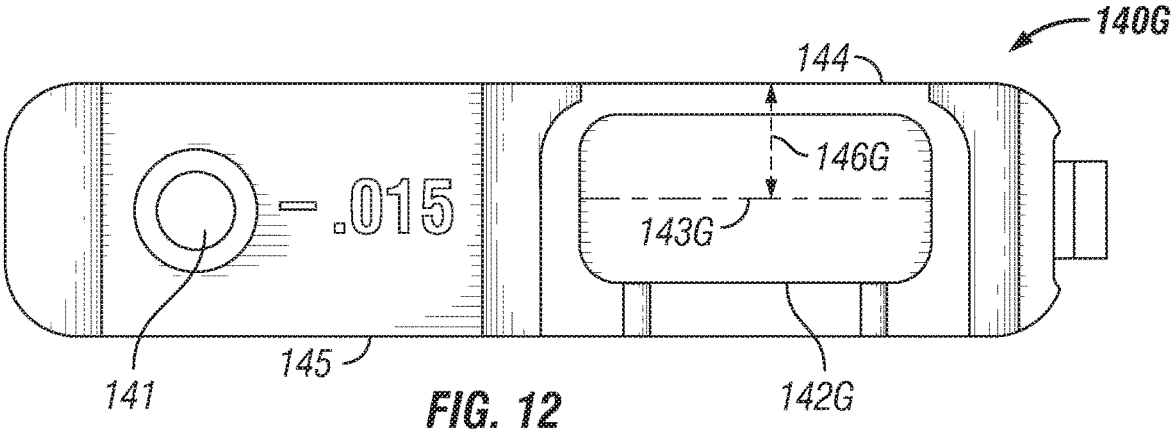
FIG. 12 is a front view schematic of an embodiment of an insert having a lockup notch.

FIG. 12, is a front view schematic of an embodiment of a seventh insert 140G having a seventh lockup notch 142G that has a seventh longitudinal centerline 143G. The seventh insert 140G includes an aperture 141 configured to receive a fastener to secure the seventh insert 140G to a magazine body 110. The seventh insert 140G includes a top edge 144 and a bottom edge 145. The seventh insert 140G has a seventh distance 146G between the top edge 144 and the seventh longitudinal centerline 143G of the seventh lock notch 142G. The seventh distance 146G is smaller than the first distance 146A, smaller than the third distance 146C, and smaller than the fifth distance 146E. Thus, the distance 160 from the top edge 121 of the feed lips 120 is smaller when the first insert 140A, the third insert 140C, or the fifth insert 140E is replaced by the seventh insert 140G. The seventh distance 146G may be 0.015 inches smaller that the first distance 146A which decreases the distance 160 by the same amount.

Figure 13:
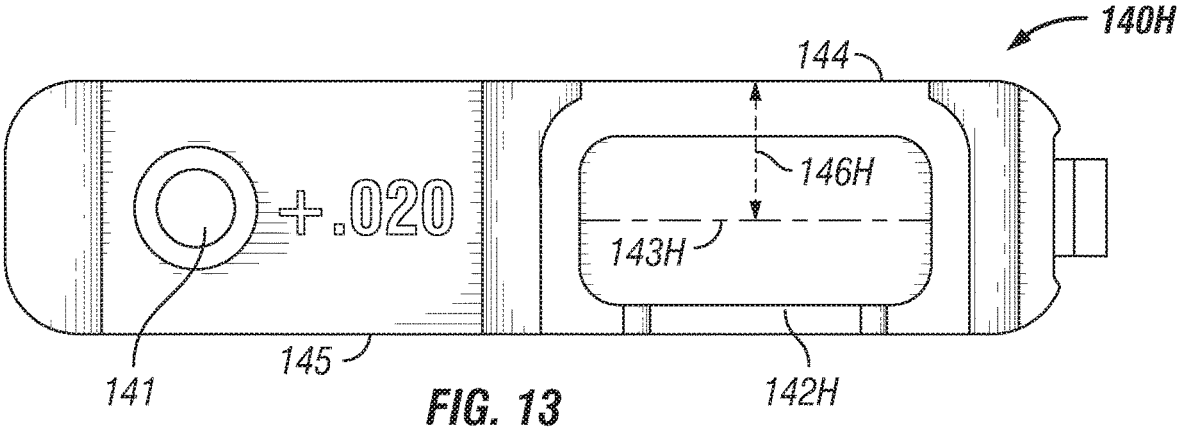
FIG. 13 is a front view schematic of an embodiment of an insert having a lockup notch.

FIG. 13, is a front view schematic of an embodiment of an eighth insert 140H having an eighth lockup notch 142H that has an eighth longitudinal centerline 143H. The eighth insert 140H includes an aperture 141 configured to receive a fastener to secure the eighth insert 140H to a magazine body 110. The eighth insert 140H includes a top edge 144 and a bottom edge 145. The eighth insert 140H has an eighth distance 146H between the top edge 144 and the eighth longitudinal centerline 143H of the eighth lock notch 142H. The eighth distance 146H is larger than the first distance 146A, larger than the second distance 146B, larger than the fourth distance 146D, and larger than the sixth distance 146F. Thus, the distance 160 from the top edge 121 of the feed lips 120 is larger when the first insert 140A, the second insert 140B, the fourth insert 140D, or the sixth insert 146F are replaced by the eighth insert 140H. The eighth distance 146H may be 0.020 inches larger that the first distance 146A which increase the distance 160 by the same amount.

Figure 14:
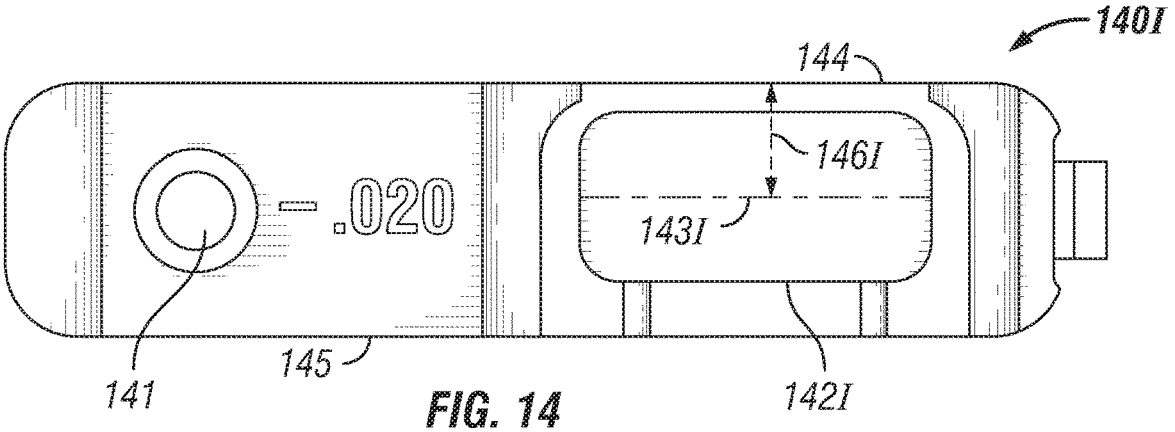
FIG. 14 is a front view schematic of an embodiment of an insert having a lockup notch.

FIG. 14, is a front view schematic of an embodiment of a ninth insert 140I having a ninth lockup notch 142I that has a ninth longitudinal centerline 143I. The ninth insert 140I includes an aperture 141 configured to receive a fastener to secure the ninth insert 140I to a magazine body 110. The ninth insert 140I includes a top edge 144 and a bottom edge 145. The ninth insert 140I has a ninth distance 146I between the top edge 144 and the ninth longitudinal centerline 143I of the ninth lock notch 142I. The ninth distance 146I is smaller than the first distance 146A, smaller than the third distance 146C, smaller than the fifth distance 146E, and smaller than the seventh distance 146G. Thus, the distance 160 from the top edge 121 of the feed lips 120 is smaller when the first insert 140A, the third insert 140C, the fifth insert 140E, or the seventh insert 140G is replaced by the ninth insert 140I. The ninth distance 146I may be 0.020 inches smaller that the first distance 146A which decreases the distance 160 by the same amount.

The various inserts 140A-140I may be used to vary the distance between the top edge 121 of the feed lips 120 to optimize the performance of a firearm as would be appreciated by one of ordinary skill in the art having the benefit of this disclosure. The distances disclosed herein may be varied. For example, the distances between the longitudinal centerlines 143A-143I may change in distances that differ from 0.005 inches.

Figure 15:
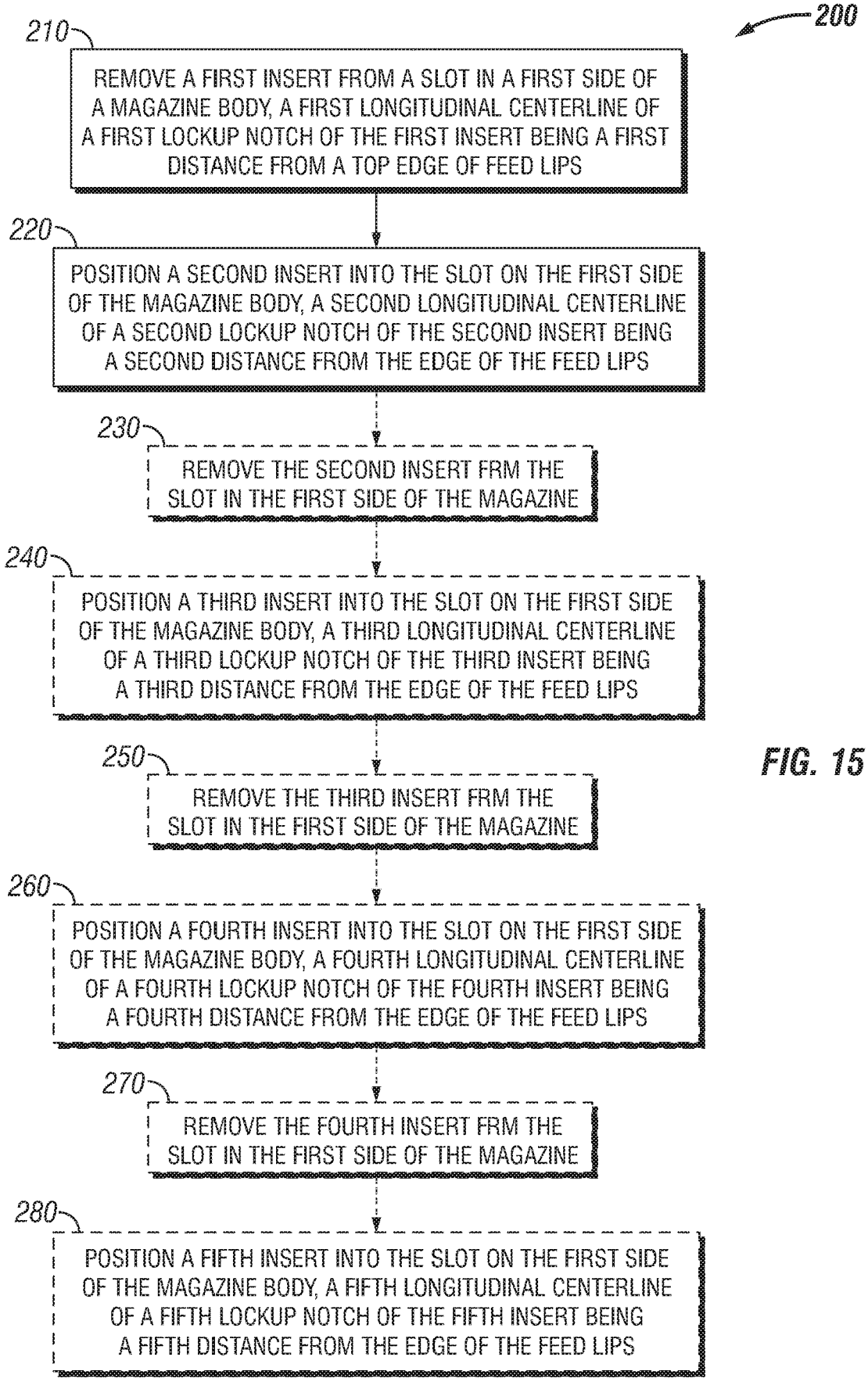
FIG. 15 is a flow chart of an embodiment of a method of the present disclosure.

FIG. 15 is a flow chart of an embodiment of a method 200 of the present disclosure. The method 200 includes removing a first insert form a slot in a first side of a magazine body, the first centerline of a first lockup notch of the first insert being a first distance form a top edge of feed lips, at 210. The method 200 includes positioning a second insert into the slot in the first side of the magazine body, a second longitudinal centerline of a second lockup notch of the second insert being a second distance from the tope edge of the feed lips, at 220.

The method 200 may include removing the second insert from the slot in the first side of the magazine body, at 230. The method 200 may include positioning a third insert into the slot in the first side of the magazine body, a third longitudinal centerline of a third lockup notch of the third insert being a third distance from the top edge of the feed lips, at 240.

The method 200 may include removing the third insert from the slot in the first side of the magazine body, at 250. The method 200 may include, positioning a fourth insert into the slot in the first side of the magazine body, a fourth longitudinal centerline of the fourth lockup notch of the fourth insert being a fourth distance from the top edge of the feed lips, at 260.

The method 200 may include removing the fourth insert from the slot in the first side of the magazine body, at 270. The method 200 may include, positioning a fifth insert into the slot in the first side of the magazine body, a fifth longitudinal centerline of the fifth lockup notch of the fifth insert being a fifth distance from the top edge of the feed lips, at 280

Although this disclosure has been described in terms of certain embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. An apparatus comprising:

a magazine body having a first side, a second side opposite the first side, a front side, a back side opposite the front side, a top side, and a bottom opposite the top side; the magazine body being configured to receive and selectively retain firearm cartridges, the magazine body having a slot in the first side;

feed lips connected to the top side of the magazine body, the feed lips having a top edge positioned away from the top side of the magazine body; and an insert positioned within the slot, the insert including a lockup notch and wherein the insert is selectively removable from the magazine body.

2. The apparatus of claim 1, wherein the lockup notch has a longitudinal centerline, the longitudinal centerline being a first distance from the top edge of the feed lips.

3. The apparatus of claim 2, wherein the insert may be replaced to change the first distance between the top edge of the feed lips and the longitudinal centerline of the lockup notch.

4. The apparatus of claim 3, further comprising finger grips on the front side of the magazine body.

5. The apparatus of claim 4, further comprising a ridge along the back side, wherein the ridge extends away from the back side.

6. The apparatus of claim 1, wherein the insert includes an aperture to receive a fastener.

7. The apparatus of claim 6, further comprising a fastener positioned within the aperture of the insert that selectively secures the insert to the magazine body.

8. A system comprising:

a magazine body having a first side, a second side opposite the first side, a front side, a back side opposite the front side, a top side, and a bottom opposite the top side; the magazine body being configured to receive and selectively retain firearm cartridges, the magazine body having a slot in the first side;

feed lips connected to the top side of the magazine body, the feed lips having a top edge positioned away from the top side of the magazine body;

a first insert having a first lockup notch with a first longitudinal centerline, wherein when the first insert is positioned within the slot in the first side of the magazine body the first longitudinal centerline is a first distance from the top edge of the feed lips; and a second insert having a second lockup notch having a second longitudinal centerline, wherein when the second insert is positioned within the slot in the first side of the magazine body the second longitudinal centerline is a second distance from the top edge of the feed lips, the second distance being different from the first distance.

9. The system of claim 8, further comprising a third insert having a third lockup notch having a third longitudinal centerline, wherein when the third insert is positioned within the slot in the first side of the magazine body the third longitudinal centerline is a third distance from the top edge of the feed lips, the third distance being different from the first distance and the second distance.

10. The system of claim 9, further comprising a fourth insert having a fourth lockup notch having a fourth longitudinal centerline, wherein when the fourth insert is positioned within the slot in the first side of the magazine body the fourth longitudinal centerline is a fourth distance from the top edge of the feed lips, the fourth distance being different from the first distance, the second distance, and the third distance.

11. The system of claim 10, further comprising a fifth insert having a fifth lockup notch having a fifth longitudinal centerline, wherein when the fifth insert is positioned within the slot in the first side of the magazine body the fifth longitudinal centerline is a fifth distance from the top edge of the feed lips, the fifth distance being different from the first distance, the second distance, the third distance, and the fourth distance.

12. The system of claim 11, further comprising a sixth insert having a sixth lockup notch having a sixth longitudinal centerline, wherein when the sixth insert is positioned within the slot in the first side of the magazine body the sixth longitudinal centerline is a sixth distance from the top edge of the feed lips, the sixth distance being different from the first distance, the second distance, the third distance, the fourth distance, and the fifth distance.

13. The system of claim 12, further comprising a seventh insert having a seventh lockup notch having a seventh longitudinal centerline, wherein when the seventh insert is positioned within the slot in the first side of the magazine body the seventh longitudinal centerline is a seventh distance from the top edge of the feed lips, the seventh distance being different from the first distance, the second distance, the third distance, the fourth distance, the fifth distance, and the sixth distance.

14. The system of claim 13, further comprising further comprising an eighth insert having an eighth lockup notch having an eighth longitudinal centerline, wherein when the eighth insert is positioned within the slot in the first side of the magazine body the eighth longitudinal centerline is an eighth distance from the top edge of the feed lips, the eighth distance being different from the first distance, the second distance, the third distance, the fourth distance, the fifth distance, the sixth distance, and the seventh distance.

15. The system of claim 14, further comprising a ninth insert having a ninth lockup notch having a ninth longitudinal centerline, wherein when the ninth insert is positioned within the slot in the first side of the magazine body the ninth longitudinal centerline is a ninth distance from the top edge of the feed lips, the ninth distance being different from the first distance, the second distance, the third distance, the fourth distance, the fifth distance, the sixth distance, the seventh distance, and the eighth distance.

16. The system of claim 15, wherein the second distance is 0.005 inches longer than the first distance, the third distance is 0.005 inches shorter than the first distance, the fourth distance is 0.005 inches longer than the second distance, the fifth distance is 0.005 inches shorter than the third distance, the sixth distance is 0.005 inches longer than the fourth distance, the seventh distance is 0.005 inches shorter than the fifth distance, the eighth distance is 0.005 inches longer than the sixth distance, and the ninth distance is 0.005 inches shorter than the seventh distance.

17. A method comprising:

removing a first insert from a slot in a first side of a magazine body, the first insert having a first lockup notch with a first longitudinal centerline, the first longitudinal centerline being a first distance from a top edge of feed lips connected to a top side of the magazine body; and positioning a second insert into the slot in the first side of the magazine body, the second insert having a second lockup notch with a second longitudinal centerline, the second longitudinal centerline being a second distance from the top edge of feed lips connected to the top side of the magazine body, the second distance being larger than the first distance.

18. The method of claim 17, wherein the method further comprises:

removing the second insert from the slot in the first side of the magazine body; and positioning a third insert into the slot in the first side of the magazine body, the third insert having a third lockup notch with a third longitudinal centerline, the third longitudinal centerline being a third distance from the top edge of feed lips connected to the top side of the magazine body, the third distance being smaller than the first distance.

19. The method of claim 18, wherein the method further comprises:

removing the third insert from the slot in the first side of the magazine body; and positioning a fourth insert into the slot in the first side of the magazine body, the fourth insert having a fourth lockup notch with a fourth longitudinal centerline, the fourth longitudinal centerline being a fourth distance from the top edge of feed lips connected to the top side of the magazine body, the fourth distance being larger than the second distance.

20. The method of claim 19, wherein the method further comprises:

removing the fourth insert from the slot in the first side of the magazine body; and positioning a fifth insert into the slot in the first side of the magazine body, the fifth insert having a fifth lockup notch with a fifth longitudinal centerline, the fifth longitudinal centerline being a fifth distance from the top edge of feed lips connected to the top side of the magazine body, the fifth distance being smaller than the third distance.

* * * * *